US012384497B1

(12) United States Patent
Jones

(10) Patent No.: US 12,384,497 B1
(45) Date of Patent: Aug. 12, 2025

(54) DETACHABLE CANOE OUTRIGGER

(71) Applicant: Raymond Jones, Blind Bay (CA)

(72) Inventor: Raymond Jones, Blind Bay (CA)

( * ) Notice: Subject to any disclaimer, the term of this patent is extended or adjusted under 35 U.S.C. 154(b) by 488 days.

(21) Appl. No.: 17/845,707

(22) Filed: Jun. 21, 2022

(51) Int. Cl.
*B63B 34/26* (2020.01)
*B63B 1/12* (2006.01)
*B63B 34/21* (2020.01)

(52) U.S. Cl.
CPC ..... *B63B 34/26* (2020.02); *B63B 1/121* (2013.01); *B63B 34/21* (2020.02)

(58) Field of Classification Search
CPC .. B63B 1/10; B63B 1/12; B63B 1/121; B63B 2001/102; B63B 34/20; B63B 34/21; B63B 34/26
See application file for complete search history.

(56) References Cited

U.S. PATENT DOCUMENTS

| | | | | |
|---|---|---|---|---|
| 8,047,153 | B2 | 11/2011 | Wood | |
| 9,555,860 | B1 * | 1/2017 | Mackro | B63B 17/00 |
| 10,023,276 | B1 | 7/2018 | Sharrer | |
| 2007/0240626 | A1 * | 10/2007 | Baker | B63B 27/146 114/362 |

FOREIGN PATENT DOCUMENTS

| | | | | |
|---|---|---|---|---|
| CA | 2421955 | A1 * | 8/2004 | B63B 1/121 |

* cited by examiner

*Primary Examiner* — Scott A Browne
*Assistant Examiner* — Jisun Choi
(74) *Attorney, Agent, or Firm* — Sanchelima & Associates, P.A.; Jesus Sanchelima; Christian Sanchelima

(57) ABSTRACT

A detachable canoe outrigger that is removably mounted to a canoe's gunwales using a dual beam assembly having two beam member that are fastened to the canoe. The beam members include slots to allow a user to selectively adjust the distance between the canoe and the outrigger. The outrigger assembly further including a ladder connected thereon to allow users to climb back onto said outrigger member and in turn onto said canoe. A net assembly is included to provide users with a means of carrying passengers thereon or items such as a cooler while they are out on the canoe.

12 Claims, 6 Drawing Sheets

DETACHABLE CANOE OUTRIGGER

II. BACKGROUND OF THE INVENTION

1. Field of the Invention

The present invention relates to a detachable canoe outrigger and, more particularly, to a detachable canoe outrigger that includes dual attachment beams with slots to selectively adjust the distance between the canoe and the outrigger.

2. Description of the Related Art

Several designs for a detachable canoe outrigger have been designed in the past. None of them, however, include an outrigger which is removably attachable to a canoe using dual attachment beams that are secured to the gunwales of the canoe.

Applicant believes that a related reference corresponds to U.S. Pat. No. 10,023,276 issued for a canoe outrigger attached to a canoe with telescopic arms having clamps on the canoe end. Applicant believes that another related reference corresponds to U.S. Pat. No. 8,047,153 issued for an outrigger for attachment to a host vessel, such as a canoe. None of these references, however, teach of a detachable canoe outrigger that includes a net extending between the canoe and outrigger to provide uses with a means of carrying passengers thereon or items such as a cooler.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a detachable canoe outrigger that includes a removably attachable canoe using dual attachment beams.

It is another object of this invention to provide a detachable canoe outrigger that includes clamps for the gunwales of the canoe as well as clamps for the top of the outrigger.

It is still another object of the present invention to provide a detachable canoe outrigger that includes an outrigger with a drop ladder with a net extending between the canoe and the outrigger to facilitate carrying passengers or items thereon.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
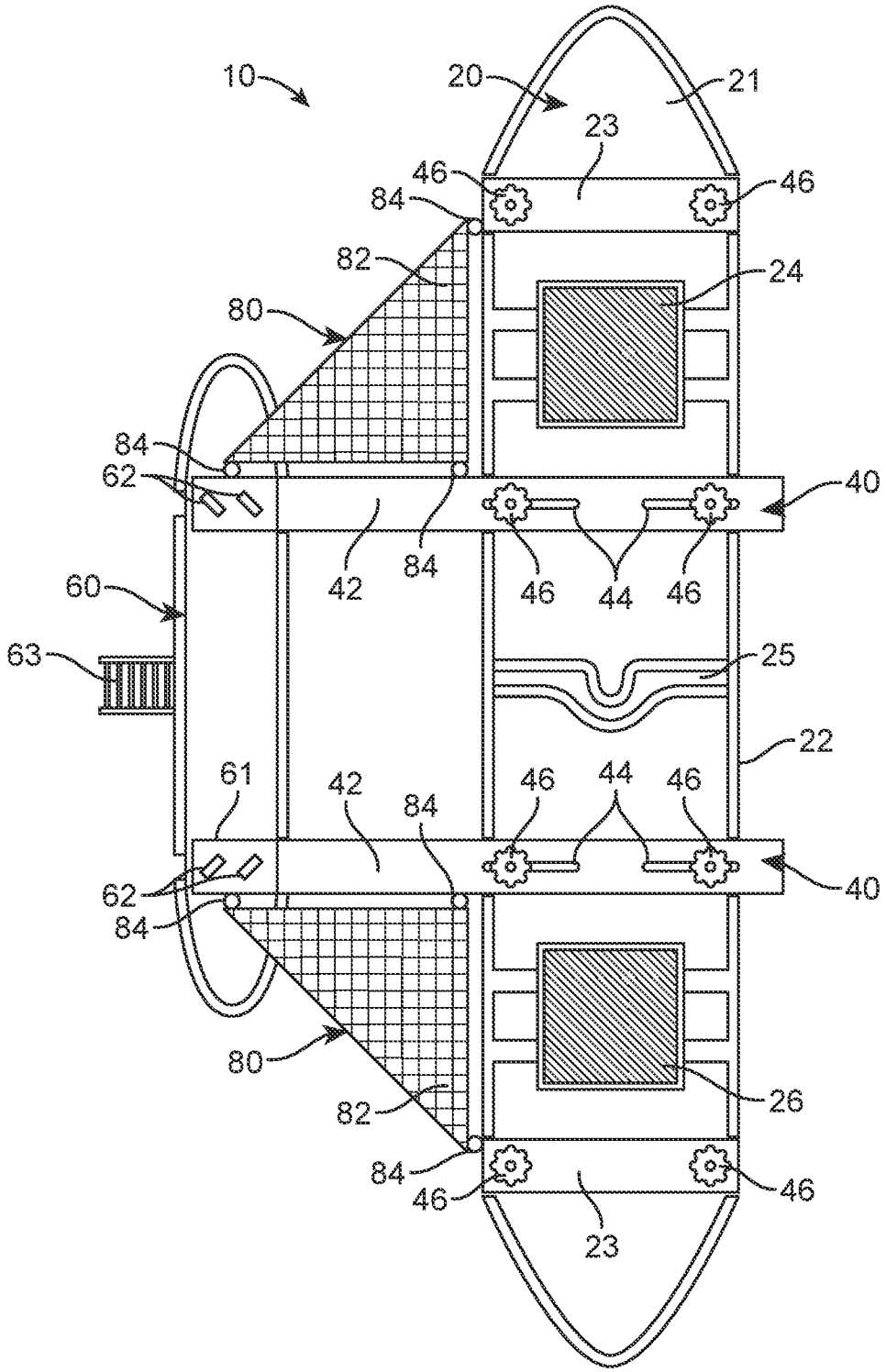

With the above and other related objects in view, the invention consists in the details of construction and combination of parts as will be more fully understood from the following description, when read in conjunction with the accompanying drawings in which:

FIG. 1 represents a top view of the present invention showing canoe assembly 20, dual beam assembly 40, outrigger assembly 60, and net assembly 80. It can further be seen dual beam assembly 40 includes beams 42 having slots 44 that allow a user to adjust the distance between the outrigger assembly 60 and canoe assembly 20. It can also be seen that the beams 42 are mounted to the gunwales 62 of the canoe assembly 20.

Figure 2:
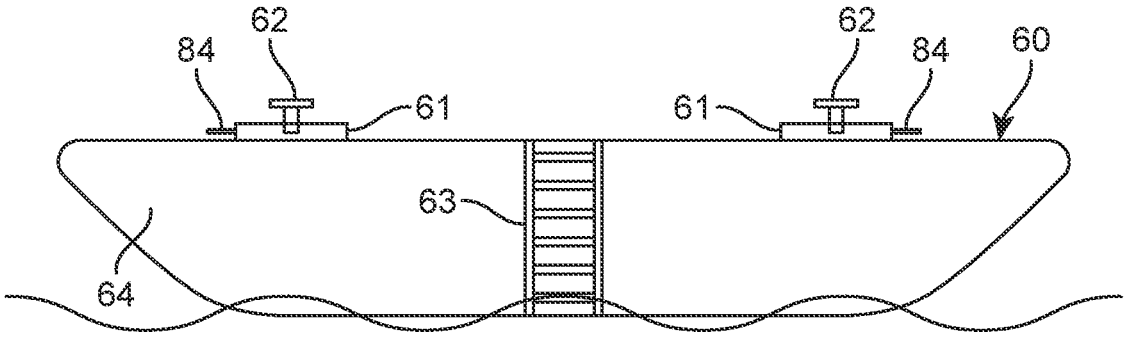

FIG. 2 shows a side view of the outrigger members 61 mounted to the top end of the outrigger 64 that is in a body of water. The outrigger members 61 including outrigger fasteners 62 mounted at a top end.

Figure 3:
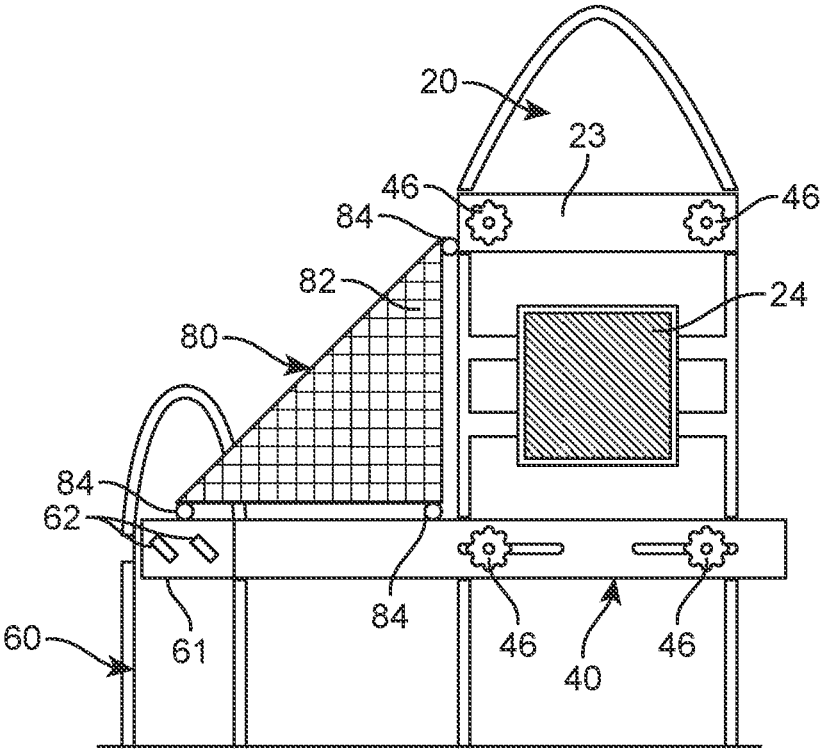

FIG. 3 illustrates an enlarged view of net assembly 80 showing how net member 82 is mounted to the outrigger assembly 60, the dual beam assembly 40 and the canoe assembly 20.

Figure 4:
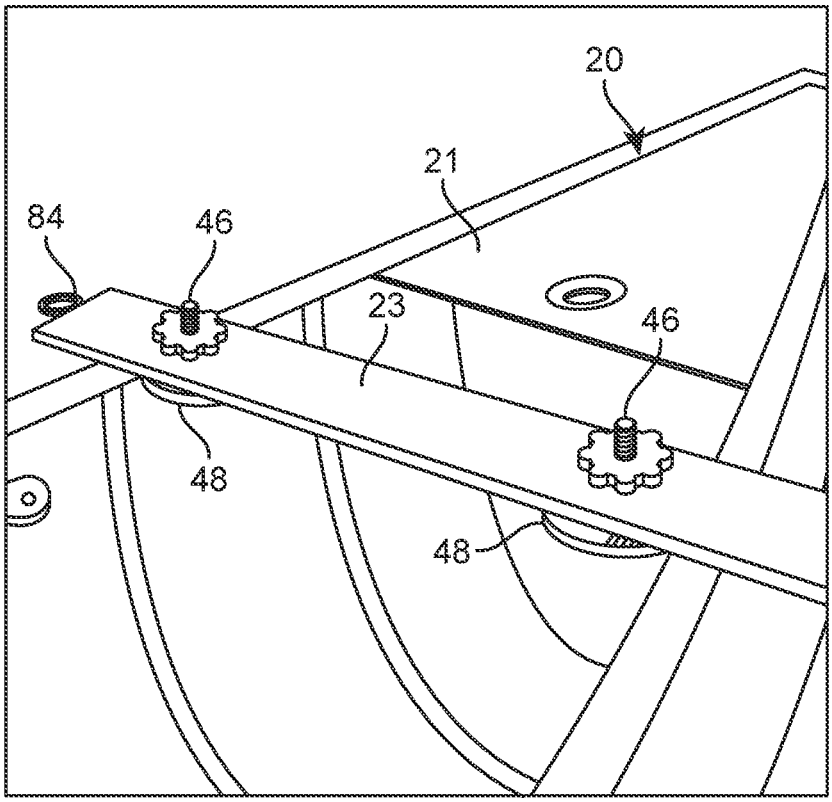

FIG. 4 represents an isometric view of the hammock anchor bar 23 located towards the distal end of the canoe assembly 20 using the bar fasteners 46 in conjunction with the jaw 48 to attach it to the canoe 21, thereby attaching the net to the canoe assembly 20.

Figure 5:
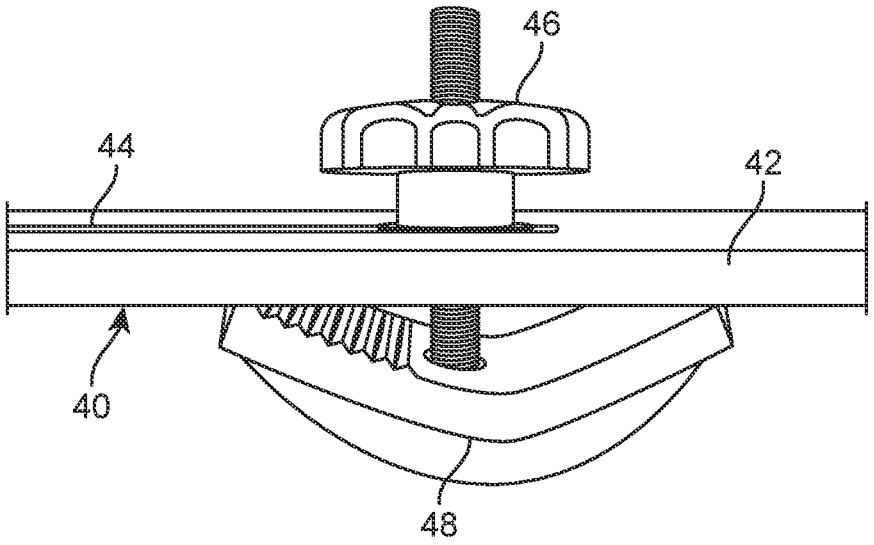

FIG. 5 is a representation of an enlarged side view of the securing mechanism in which the bar fastener 46 traverses one of the slots 44 to engage one of the jaws 48 and mount the beams 42 to the gunwales 22 of the canoe 21, as shown in FIG. 1.

Figure 6:
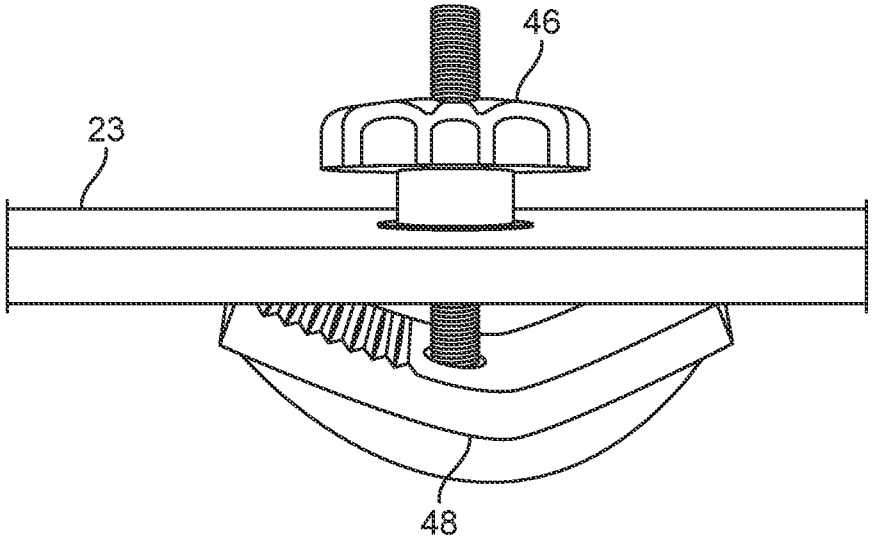

FIG. 6 depicts an enlarged side view of the securing mechanism in which the bar fastener 46 traverses the hammock anchor bar 23 through a fixed point to engage one of the jaws 48 and mount said hammock anchor bar 23 to a distal end of the canoe 21, as shown in FIG. 4.

Figure 7:
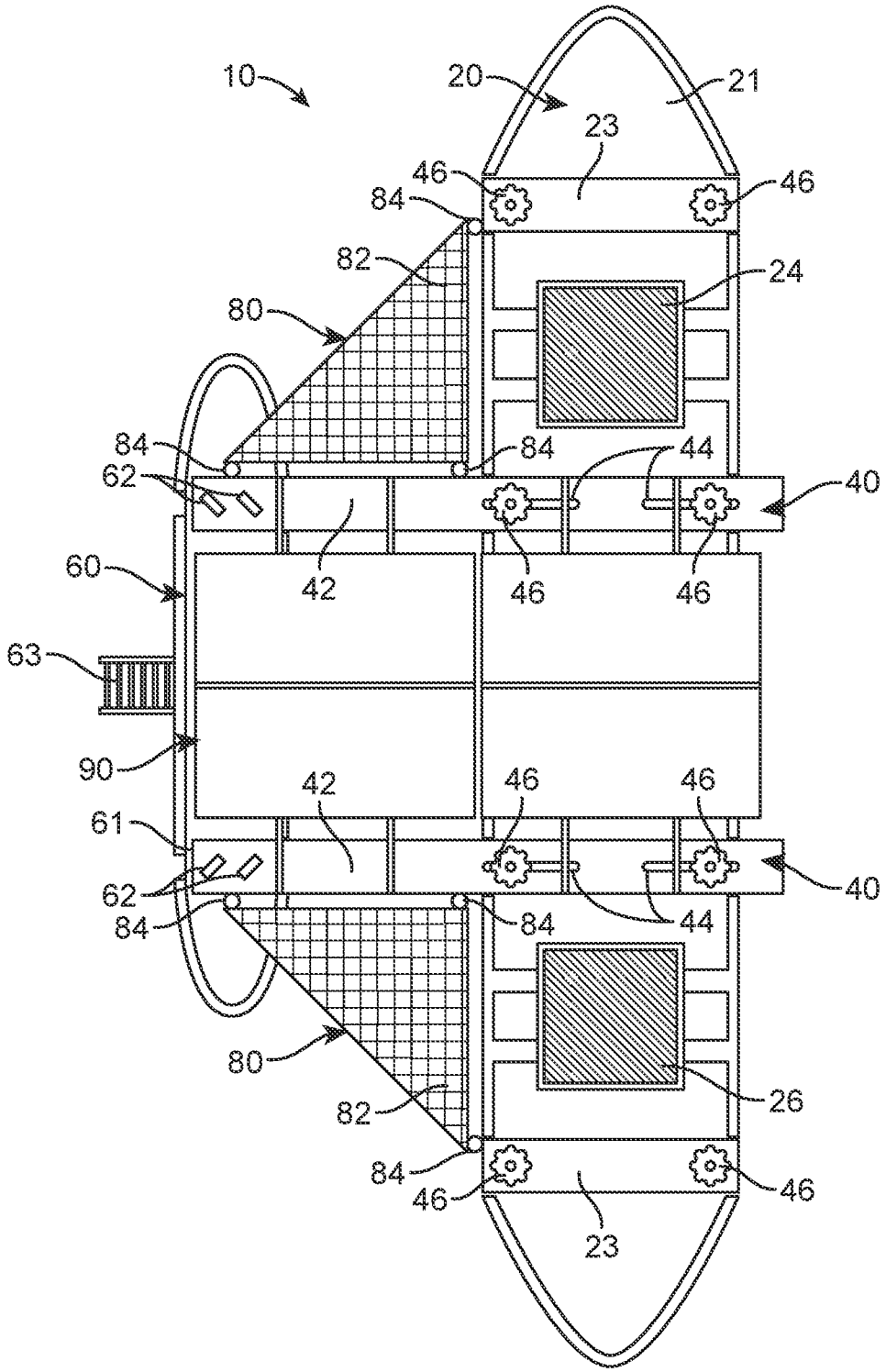

FIG. 7 represents a top view of the canoe assembly 20 having the platform assembly 90 mounted thereon. The platform assembly 90 includes a platform 92 that is to be mounted thereon to create a walkway for a user to get to the outrigger with ease.

Figure 8:
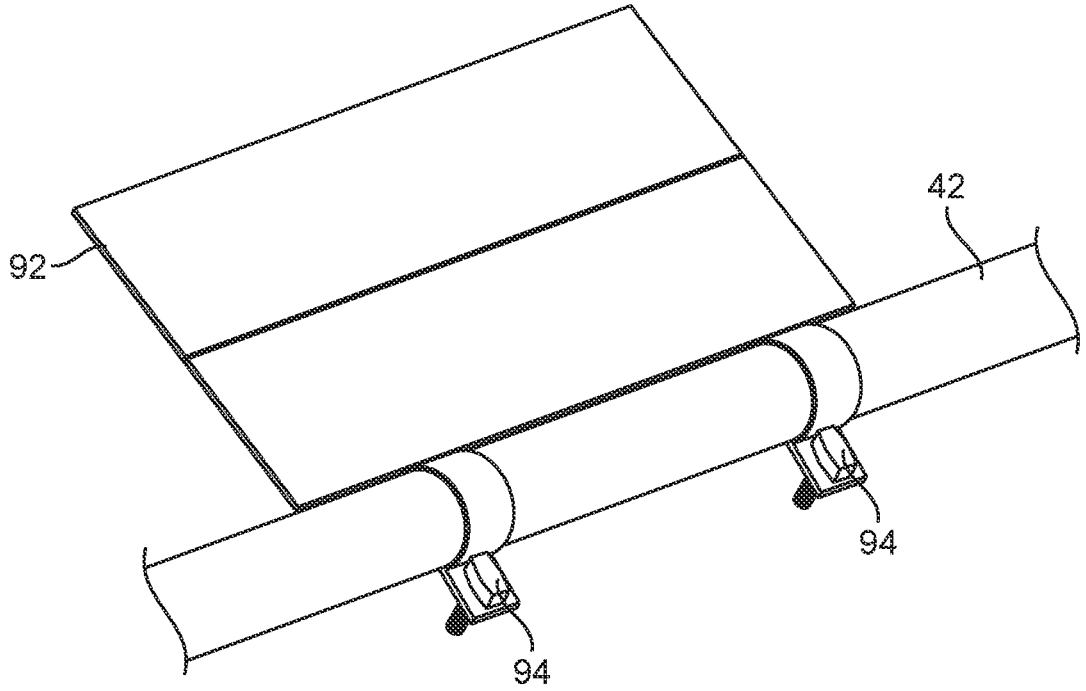

FIG. 8 represents an exemplary embodiment of the present invention, wherein the platform assembly 90 includes platform fasteners 94 to secure the platform 92 to the beams 42.

V. DETAILED DESCRIPTION OF THE EMBODIMENTS OF THE INVENTION

Referring now to the drawings, where the present invention is generally referred to with numeral 10, it can be observed that it basically includes a canoe assembly 20, a dual beam assembly 40, an outrigger assembly 60, and a net assembly 80. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

As illustrated in FIG. 1 canoe assembly 20 may include a canoe 21. In multiple embodiments the canoe 21 may be a tripping canoe, sporting canoe, recreational canoe, or any variation thereof. The canoe 21 may include a yoke 25, a bow seat 24, and a stern seat 26 mounted therein. The yoke 25 may be mounted perpendicularly across the canoe 21 lateral sides. The yoke 25 may take the form of a curved crossbeam that facilitates a user carrying the canoe 21 when it is out of the water. It may be suitable for each of the bow seat 24 and the stern seat 26 to include a squared seating portion with perpendicular mounting points extending from their respective lateral sides that attach to the gunwales 22 of the canoe 21. The gunwales 22 may run along the entirety of a top perimeter edge of the canoe 21. Located on opposing distal ends of the canoe 21 may be hammock anchor bars 23.

Best shown in FIG. 4 the hammock anchor bars 23 may be an elongated rectangular member that includes a net fastening member 84 integrally formed at a hammock anchor bar distal end. Referring now to FIG. 6, the hammock anchor bars 23 may include a bar fastener 46 that traverses said hammock anchor bars 23 perpendicularly through a top portion to engage with a jaw 48. The bar fastener 46 may include a knob portion that allows the user to tighten or loosen the jaw 48. Thereby enabling the user to mount and dismount the hammock anchor bars 23 to the gunwales 22 of the canoe 21.

In FIG. 1 it is shown that dual beam assembly 40 may include beams 42. The beams 42 may be elongated rectangular members that are perpendicularly mounted to the gunwales 22 on either side of a midpoint of the canoe 21. The beams 42 may be removably attachable to the gunwales 22. As demonstrated in FIGS. 1 and 5 the beams 42 may include slots 44 located at a first distal end. In one embodiment, the slots 44 may be a pair of apertures longitudinally disposed about a portion of the beams 42 that aligns with the interior of the canoe 21. It may be suitable for the bar fasteners 46 and to engage the jaws 48 by traversing the slot 44. The jaws 48 may be curved members that include a top portion with ridges. The ridges of the jaws 48 allowing the beams 42 to be more securely fastened to the gunwales 22. The slots 44 allows the user to selectively adjust the distance between the canoe 21 and the outrigger assembly 60. It may be preferable for each of the beams 42 to include a net fastening member 84 disposed about a middle portion.

It may be preferable for a second distal end of the beams 42 to be received by outrigger members 61 of outrigger assembly 60 as shown in FIGS. 1 and 3. Referring now to FIG. 2 the outrigger members 61 may be mounted to a top end of the outrigger 64. It should be understood that the outrigger 64 may include any variation of a float or secondary hull that is fixed parallel to the canoe 21 via the dual beam assembly 40. In one embodiment the outrigger members 61 may be mounted in pairs on opposing ends of the outrigger 64. The outrigger members 61 may include a rectangular sleeve that receives the second of the beams 42 therein. The outrigger members 61 may be made out of a metallic material such as aluminum. Wherein the outrigger members 61 secure the beams 42 via outrigger fasteners 62. The outrigger fasteners 62 may be threaded members engaging perpendicularly with an outrigger member top end that can be tightened or loosened to secure the beams 42 within the outrigger members 61. In multiple embodiments the outrigger fasteners 62 may be lag bolts, socket bolts, hex bolts, square bolts, t bolts, knob bolts, or any variation thereof. The outrigger members 61 may also include net fastening members 84 integrally formed to an exterior portion. It may be suitable for the outrigger 64 to further include a ladder 63 mounted to a lateral side. The ladder 63 may enable the user to climb in and out of the present invention while the canoe 21 is in the water.

As best depicted in FIGS. 1 and 3 net assembly 80 may include a net member 82. In one embodiment the net member 82 may be a triangular net mounted to the net fastening members 84 located on each of said hammock anchor bars 23, the beams 42, and the outrigger members 61. In one implementation a net member 82 may be mounted adjacent to the bow seat 24 and another net member 82 may be mounted adjacent to the stern seat 26. It may be suitable for the aforementioned implementation of the net members 82 to be mounted in a mirrored configuration with respect to one another. The net member 82 may allow for a user to carry passengers or items such as coolers or fishing gear thereon.

As shown in FIG. 7, the present invention includes a platform assembly 90 having a platform 92, and platform fasteners 94. In one exemplary embodiment, the platform may have a rectangular shape with a suitable area to permit a user to stand thereupon. In different embodiments, the platform 92 may have different suitable shapes such as a quadrangular shape, a rounded shape, a regular polygonal shape, an irregular shape, and/or the like. The platform 92 may be made of a resistant, durable, and sturdy material. In different embodiment, the platform 92 may be made of wood, aluminum, steel, steel alloys, natural or synthetic fibers, metal, polymers, and/or any other suitable material as known in the art. In one embodiment, the platform 92 may be a single-piece platform. In another embodiment, the platform 92 may be foldable for easy storing. The platform 92 may be removably attached to the beams 42 by means of the platform fasteners 94. Best shown in FIG. 8, in an exemplary embodiment, the platform fasteners 94 may be located at lateral sides of the platform 92. In one embodiment, the platform fasteners 94 may be T-bolt screws. However, platform fasteners 94 may be any other suitable fastener as known in the art that permits to removably fix an element in a predetermined place.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A detachable canoe outrigger, comprising:

a. A canoe assembly including a canoe having a gunwale extending along a top perimeter edge wherein said canoe includes a bow seat and a stern seat, each mounted between a single beam and a single hammock anchor bar on opposing ends of the canoe;

b. A dual beam assembly having beams including the single beam, bar fasteners, said beam having slots, said bar fasteners connecting said beams to said gunwale;

c. An outrigger assembly including an outrigger maintained at least substantially parallel to said canoe using said dual beam assembly, wherein the beams of said dual beam assembly are received by outrigger members mounted to an outrigger top end, said outrigger assembly further including a ladder connected thereon adapted to allow users to climb back onto said outrigger and in turn onto said canoe; and d. a net assembly including a net member adapted to carry passengers or items, said net member attached to said canoe assembly using at least one net fastening member, said net member attached to said outrigger assembly using at least one net fastening member, thereby creating a platform between said canoe assembly and said outrigger assembly to carry said passengers or said items.

2. The detachable canoe outrigger of claim 1 wherein said net member is a triangular hammock.

3. The detachable canoe outrigger of claim 1 wherein said beams are elongated rectangular members.

4. The detachable canoe outrigger of claim 1 wherein said canoe includes a yoke mounted therein about a middle portion.

5. The detachable canoe outrigger of claim 4 wherein said beams are positioned on opposing sides of the yoke.

6. The detachable canoe outrigger of claim 1 wherein said canoe assembly includes hammock anchor bars including the single hammock anchor bar mounted to the gunwale on opposite ends of the canoe.

7. The detachable canoe outrigger of claim 6 wherein said bar fasteners include a threaded member that engages a jaw to secure said beams and said hammock anchor bars to the gunwale.

8. The detachable canoe outrigger of claim 7 wherein said hammock anchor bars include said at least one net fastening member to further secure the net member to the canoe.

9. The detachable canoe outrigger of claim 1 wherein said slots are a pair of apertures longitudinally disposed about a portion of the beams that aligns with an interior of the canoe when mounted thereon.

10. The detachable canoe outrigger of claim 1 wherein said outrigger members are rectangular sleeves including an outrigger fastener to secure the beams therein.

11. The detachable canoe outrigger of claim 1 further including a platform assembly having a foldable platform which is removably secured to the beams by means of platform fasteners which are located at lateral sides of the platform.

12. A detachable canoe outrigger, consisting of:

a. A canoe assembly including a canoe having a gunwale extending along a top perimeter edge, the canoe further including hammock anchor bars mounted to the gunwale on opposite ends of the canoe, wherein said canoe includes a yoke mounted therein about a middle portion;

b. A dual beam assembly including beams having an elongated rectangular shape, bar fasteners, said beam having slots, wherein said slots are a pair of apertures longitudinally disposed about a portion of the beams that aligns with an interior of the canoe when mounted thereon, said bar fasteners including a threaded member that engages a jaw to secure said beams and said hammock anchor bars to the gunwale, the beams positioned on opposing sides of the yoke, the canoe further including a bow seat and a stern seat on opposing sides of said canoe, wherein the bow seat is between a first beam and a first hammock anchor bar and the stern seat is between a second beam and a second hammock anchor bar;

c. An outrigger assembly including an outrigger maintained at least substantially parallel to said canoe using said dual beam assembly, wherein the beams of said dual beam assembly are received by outrigger members mounted to an outrigger top end, the outrigger members being rectangular sleeves including an outrigger fastener to secure the beams therein, said outrigger assembly further including a ladder connected thereon adapted to allow users to climb back onto said outrigger and in turn onto said canoe;

d. a net assembly including a net member adapted to carry passengers or items, said net member being a triangular hammock that is attached to said beams using at least one net fastening member, said net member attached to said outrigger members using at least one net fastening member, said net member attached to said hammock anchor bars using at least one net fastening member, thereby creating a platform between said canoe assembly and said outrigger assembly to carry said passengers or said items; and e. a platform assembly having a foldable platform which is removably secured to the beams by means of platform fasteners which are located at lateral sides of the platform.

* * * * *